United States Patent [19]

Bseisu et al.

[11] Patent Number: 4,715,451

[45] Date of Patent: Dec. 29, 1987

[54] MEASURING DRILLSTEM LOADING AND BEHAVIOR

[75] Inventors: Amjad A. Bseisu, Dallas; Yih-Min Jan; Frank J. Schuh, both of Plano, all of Tex.

[73] Assignee: Atlantic Richfield Company, Los Angeles, Calif.

[21] Appl. No.: 908,132

[22] Filed: Sep. 17, 1986

[51] Int. Cl.[4] ..... E21B 47/00

[52] U.S. Cl. ..... 175/40; 73/151

[58] Field of Search ..... 175/24, 27, 40, 56; 73/151

[56] References Cited

U.S. PATENT DOCUMENTS

| | | | |
|---|---|---|---|
| 3,520,375 | 7/1970 | Raynal et al. | 73/151 |
| 3,626,482 | 12/1971 | Quichaud et al. | 73/151 |
| 4,150,568 | 4/1979 | Berger et al. | 73/151 |

FOREIGN PATENT DOCUMENTS

| | | | |
|---|---|---|---|
| 0909140 | 2/1982 | U.S.S.R. | 175/40 |

*Primary Examiner*—Stephen J. Novosad
*Assistant Examiner*—Bruce M. Kisliuk
*Attorney, Agent, or Firm*—Michael E. Martin

[57] ABSTRACT

A drillstem loading and behavior measurement method and system includes spaced apart subs disposed at the upper end of the drillstem and connected to each other and to a power or conventional swivel and having strain gages and accelerometers mounted thereon in such a way as to measure axial loading, axial vibration, torsional loading, torsional vibration and bending modes of the drillstem during operation. Accelerometers are mounted on respective ones of the subs at a distance from each other sufficient to determine vibration waveforms in axial, torsional and bending modes.

15 Claims, 7 Drawing Figures

MEASURING DRILLSTEM LOADING AND BEHAVIOR

BACKGROUND OF THE INVENTION

1. Field of the Invention

The present invention pertains to a method for measuring drillstem deflections and downhole drillstemcasing interaction and a system including an arrangement of strain gages and accelerometers for measuring vibrations, deflections and forces acting on the drillstem.

2. Background

In the drilling of oil and gas wells, it has been observed that severe wellbore casing wear has occurred to the point of unwanted penetration of the casing wall. In certain drilling operations unexplained vibrations and drillstem motions have also resulted in significant damage and failure of drillbits and other downhole portions of the drillstem beyond that which is explainable by sensing torque, rotary speed and weight on the bottom hole assembly.

Prior art efforts to develop instrumented drillstems have included the use of an instrumented assembly in the drillstem near the lower or bottom end thereof. However, this type of technique presents signal transmission problems and exposes the instrumentation to the pressures, temperatures and severe accelerations that occur at the lower end of the drillstem. Efforts have also been made to place devices such as accelerometers on the extreme upper end of a drillstem such as on the conventional swivel or drillstem supporting structure. Efforts have also been made to develop tools for measuring torque between a conventional rotary table and a drillstem. Such efforts have included the use of a radio transmitter to broadcast strain gage measurement signals. Accordingly, even though it has been contemplated to place sensing devices, including strain gages, at points along the drillstem below the surface and in proximity to the drillbit so as to measure total loading exerted on the bit as well as torsional, axial and lateral vibrations or deflections of at least portions of the drillstem, the operating environment in the borehole as well as the length of some drillstems tends to preclude the provision of a suitable service life for downhole instruments and complicates the transmission of signals to surface monitoring and recording devices.

There has been a long-standing need to provide a system for measuring the stresses and strains exerted on a drillstem so as to improve the service life of the drillstem, the bit, any downhole tools or motors used in the drillstem and to minimize wear on the drillstem and borehole structures such as metal casings which may be prematurely worn or damaged by engagement with the drillstem during severe loading or deflection thereof. Moreover, the collection and analysis of information regarding drillstem behavior in the vicinity of the bit or at other points along the drillstem below the surface can be useful in improving the bit penetration rate, the life of the drillstem, and to correct for operating conditions which may lead to premature failure or excessive wear on the drillstem or other wellbore structures.

Important goals in this regard include the elimination of excessive vibration induced casing wear, the quick identification of damaging bottom hole assembly vibrations, improvement in the performance of bottom hole assemblies intended to drill vertical as well as deviated or angle drill holes, and to provide a method for identifying and then eliminating vibrations that cause surface accelerations of the drillstem that mask the correlation between certain accelerations and deflections and occurrences in the hole which can be used to determine formation conditions or minimize unwanted failures of the drilling assembly. It is to this end that the present invention has been developed with a view to providing a method and system for measuring drillstem loading and behavior under various operating conditions.

SUMMARY OF THE INVENTION

The present invention provides an improved system for measuring the strain on an elongated drillstem extending into a subterranean wellbore, for example, and for measuring modes of vibration and deflection of the drillstem under various operating conditions.

In accordance with one aspect of the present invention, a rotary drillstem is provided with a stress and vibration measuring system which is disposed at the surface in the vicinity of a drilling apparatus and may be adapted for use with a so-called rotary table type drillstem rotating system or for use of the drillstem with a so-called top drive or power swivel type rotating system.

In accordance with another aspect of the present invention, a system is provided for measuring axial and torsional forces exerted on a drillstem and for measuring axial vibrations and lateral deflection of the drillstem utilizing surface wave measurement techniques and employing a system of accelerometers for detecting axial, torsional and lateral displacements. The arrangements of accelerometers may be operated in conjunction with a signal collecting, transmission and recording system which preferably includes radio transmission of signals from a transmitter mounted on the drillstem to a receiver which may be located at a site remote from the drillstem and the drilling apparatus itself.

Signals generated by the particular array of accelerometers in accordance with the invention may be utilized to determine torsional vibration, axial deflection or vibration and lateral deflection or bending of the drillstem. The unique array or arrangement of accelerometers may also be utilized to determine the direction of bending of the drillstem. In particular, by utilizing accelerometers which are responsive to high frequency accelerations of an oscillatory nature, measurements may be taken at the earth's surface which correlate with downhole torsional, axial and lateral excursions of the drillstem in the vicinity of the bit or at other points along the drillstem. These measurements may be utilized to determine the location of drillstem interaction with well casing or other wellbore structures, a particular point of excessive torsional drag or sticking of the drillstem, drillbit operating characteristics, and rotational speed, whether driven by surface means or by a downhole motor.

The abovementioned advantages and superior features of the present invention as well as other aspects thereof will be further appreciated by those skilled in the art upon reading the detailed description which follows in conjunction with the drawing.

DESCRIPTION OF A PREFERRED EMBODIMENT

Figure 1:
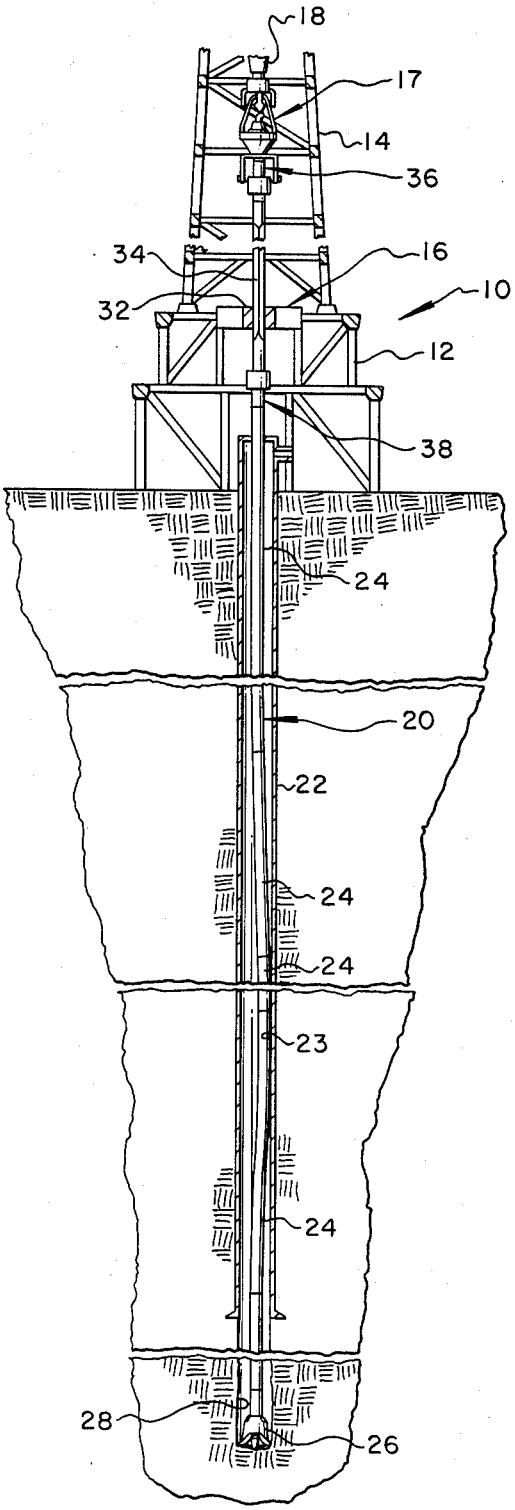
FIG. 1 is a vertical section view of a drilling apparatus and drillstem, including the drillstem loading and behavior measuring system of the present invention.

In the description which follows, like parts are marked throughout the specification and drawing with the same reference numerals, respectively. The drawing figures are not necessarily to scale and certain elements are shown in schematic form in the interest of clarity and conciseness. Conventional elements may be referred to in general terms only or referenced as to a commercial source.

Referring to FIG. 1, there is illustrated a conventional drilling apparatus, generally designated by the numeral 10 including a substructure 12 and a derrick 14. The substructure 12 supports a conventional rotary table 16, and a conventional swivel 17 is suspended from a traveling block 18 which is supported by the derrick 14 for traversing a drillstem 20 into and out of a wellbore defined in part by a hollow cylindrical casing 22. The drillstem 20 is conventional and is made up of end-to-end connected tubular members 24 and a rotary drillbit 26 disposed at the lower end thereof for drilling a wellbore 28. Rotation is imparted to the drillstem 20 through the rotary table 16 by a bushing 32 which is adapted to rotatably drive an elongated stem member 34 commonly known as a kelly. In accordance with the present invention, the kelly 34 is interposed in the drillstem 20 between upper and lower subs 36 and 38. The lower sub 38 is connected to the uppermost drillstem member 24 and the upper sub 36 is suitably connected to the swivel 17 in a conventional manner. The subs 36 and 38 and the kelly 34 comprise a system which includes a plurality of strain and acceleration sensing devices which will be described in further detail herein.

The elongated drillstem 20 comprises conventional steel tubular members well known in the art and is a relatively flexible structure which is subject to substantial axial, torsional and lateral vibrations and deflections. One problem in the art of drilling oil and gas wells pertains to the lateral deflection of the drillstem which results in engagement with the inner wall of the casing 22, as indicated at 23 for example, which, during rotation of the drillstem, may cause excessive wear of the casing structure and the drillstem itself. This action can cause either early failure of one or both members or damage which can present operational problems later in the life of the well. Clearly, the detection of drillstem-to-casing interaction in relatively deep wells can be difficult considering the overall length and flexibility of the drillstem and the multiple casing sections of different diameter which preclude accurate signal transmission through the casing itself. Still further, the substantial axial and torsional forces exerted on the drillstem at the surface, and considering the torsional flexibility of the drillstem, present problems in detecting excessive vibrations of the drillbit.

Figure 2:
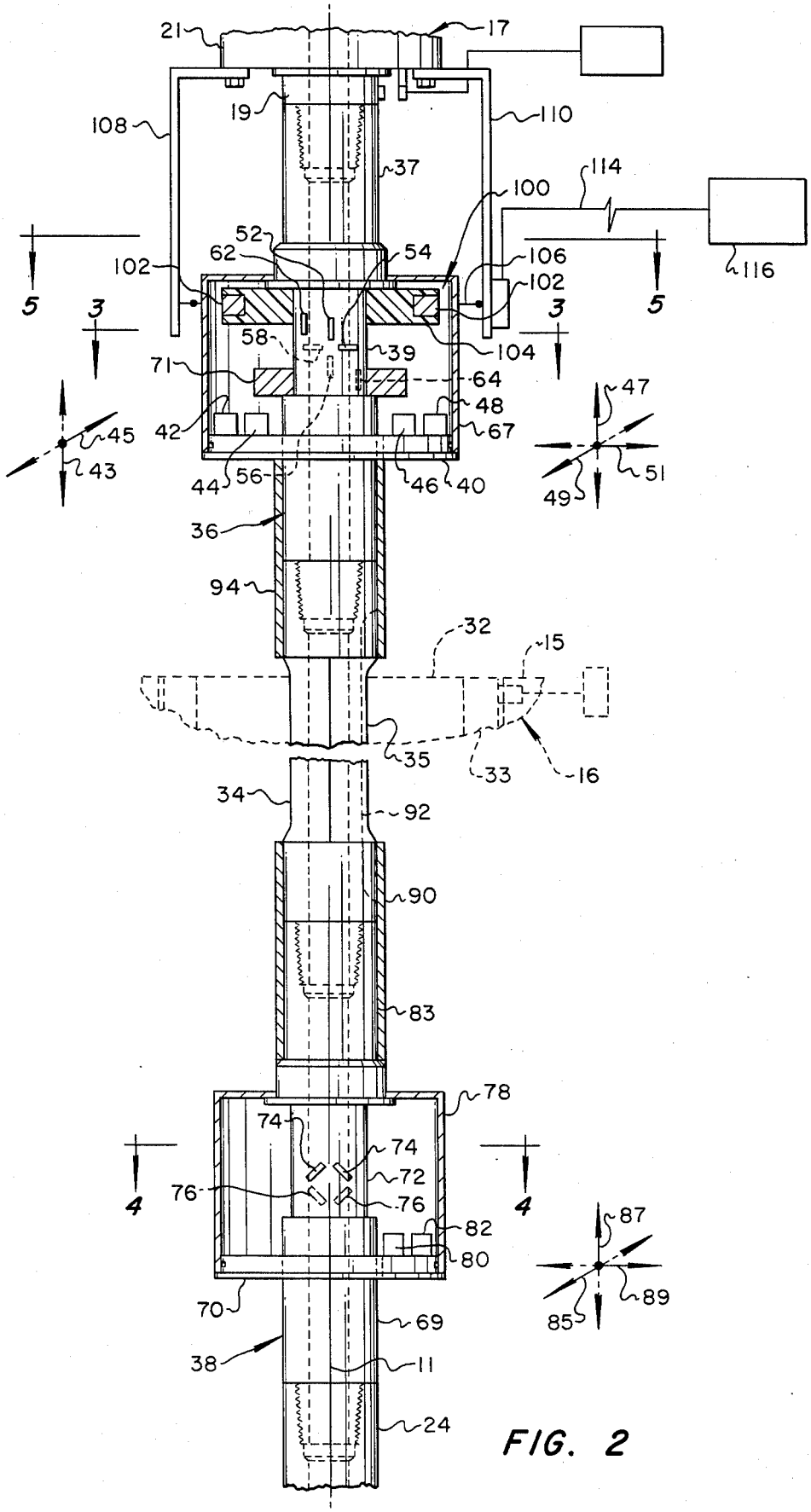
FIG. 2 is a detail view, partially sectioned, illustrating the arrangement of the sensing and signal transmitting components of the system of the present invention on a drillstem having a conventional rotary table type rotary drive.

Referring now to FIG. 2, in particular, the assembly of the kelly 34 and the upper and lower subs 36 and 38, respectively, is illustrated in further detail. The kelly 34 is substantially a conventional elongated tubular member having a portion 35 of polygonal cross-section for non-rotatable but axial movement relative to the drive bushing 32. The bushing 32 is typically removably disposed in a member 33 which is supported on suitable bearings, not shown, for rotation relative to the frame 15 of the rotary table 16. Accordingly, the rotary table 16 is adapted to impart rotary motion to the drillstem 20 through the kelly but the kelly is disposed for axial movement relative to the rotary table as the bit penetrates the formation to form a wellbore. The kelly 34 is connected to the subs 36 and 38 through conventional threaded connections. The sub 36 is also threadedly connected to a sub 19 forming part of the swivel 17 and is mounted for rotation relative to the swivel frame 21 by suitable bearing means, not shown.

Figure 3:
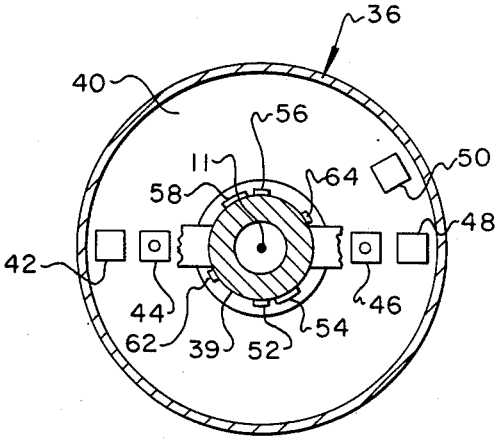
FIG. 3 is a section view taken along line 3—3 of FIG. 2.

The sub 36 is characterized by an elongated substantially tubular member 37 having a slightly reduced diameter portion 39 and a first transversely extending, generally circular flange portion 40. The flange 40 is adapted to support a plurality of relatively sensitive accelerometers 42, 44, 46, 48 and 50, see FIG. 3 also. The specific location of these accelerometers is such that the axes of movement sensed by the accelerometers 42 and 44 intersect and the axes of movement sensed by the accelerometers 46, 48 and 50 also intersect as indicated by vector diagrams to be described. The tubular portion 39 is adapted to have mounted on its exterior surface an arrangement of strain gages 52, 54, 56 and 58 which are of the electrical resistence type and preferably disposed in a conventional Wheatstone bridge type circuit. The gages 52, 54, 56 and 58 are adapted to measure axial elongation of the portion 39 of the sub 36 and thus the axial load on the drillstem 20. A second arrangement of strain gages comprise those mounted for axial elongation with respect to the central longitudinal axis 11 of the drillstem and are characterized by gages 62 and 64 which are mounted on the cylindrical outer surface of the tubular portion 39 and are responsive to relatively high frequency axial deflections or waves which have been determined to travel along the outer surface of the drillstem 20. The gages 62 and 64 are diametrically opposed to each other and may be electrically connected in series or in a Wheatstone bridge configuration. The orientation of the gages on the sub 36 are indicated in FIG. 2 and their angular position about the longitudinal axis 11 is indicated somewhat schematically in FIG. 3. A removable, nonmetallic cover 67 is disposed over the sensing elements on the sub 36, and a power source 71, such as a battery unit, may be mounted directly on the sub 36.

The vector diagrams associated with FIG. 2 indicate the directions of acceleration in each instance wherein a so-called positive acceleration signal is indicated by the respective accelerometers mounted on the flange 40. For example, the accelerometer 42 gives a positive acceleration signal in response to vertical downward movement as indicated by the vector 43. The accelerometer 44 gives a positive acceleration signal when moving tangentially in a direction indicated by the vector 45 in a clockwise direction about the axis 11, viewing FIG. 3. In like manner, the accelerometer 48 produces a positive output signal in response to axial movement in the direction of the vector 47, the accelerometer 46 produces a positive signal when moving in the direction of the vector 49 about the axis 11 and the accelerometer 50 provides a positive signal when moving away from the axis 11 in the direction of the vector 51. The dashed vector lines in FIG. 2 extending in opposite directions with respect to each of the respective vectors aforementioned indicate the direction of movement of the respective accelerometers when a negative amplitude signal is produced by each accelerometer, respectively.

Figure 4:
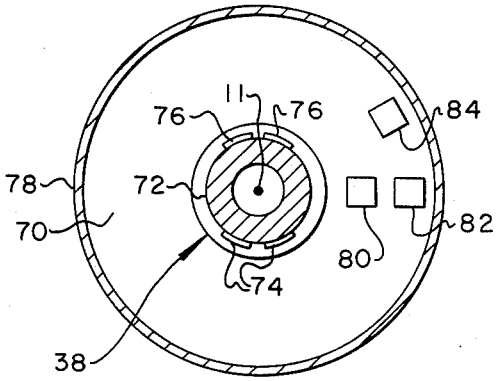
FIG. 4 is a section view taken along line 4—4 of FIG. 2.
Figure 5:
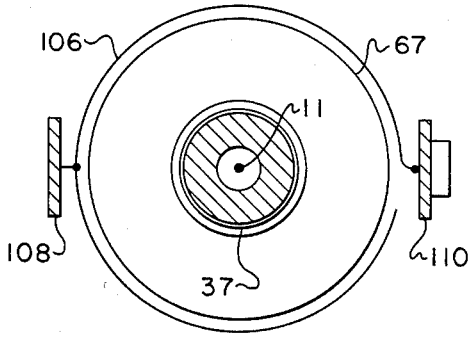
FIG. 5 is a section view taken along line 5—5 of FIG. 2.

Referring further to FIG. 2 and also FIG. 4, the sub 38 is also characterized by a tubular portion 69 provided with a transverse cylindrical flange 70 and a reduced diameter section 72 on which opposed strain gages 74 and 76 are mounted for measuring deflection of the sub 38 under torsional loading of the drillstem. The second set of strain gages 76 are mounted in a chevron or "V" configuration opposite the strain gage 74 and are preferably electrically interconnected in an appropriate bridge circuit. The transverse flange 70 is provided with a removable cover 78 for enclosing the strain gages 76 and 74 and for enclosing accelerometers 80, 82 and 84, FIG. 4, for measuring tangential, axial and radial accelerations of the sub 38, respectively. The vector diagram associated with the set of accelerometers 80, 82 and 84 indicates that a vector 85 is related to a positive signal generated by the accelerometer 80 in response to tangential movement of the sub 38 about the axis 11 whereas the vector 87 corresponds to a positive upward movement of the accelerometer 82 and a vector 89 corresponds to radial translation of the accelerometer 84 outwardly from the axis 11. The diameter of the flange 70 should be, of course, no greater than what would permit movement of the sub 38 through the opening provided for the bushing 32 in the table member 33.

The strain gages 74 and 76 and the accelerometers 80, 82 and 84 are provided with suitable signal conductors which are trained along a shank 83 of the sub 38 within a protective sleeve 90 and then through a longitudinal groove 92 which extends through the kelly 34 and along the outer surface of the sub 36, protected by a sleeve 94, and through a suitable passage in the flange 40 to a signal conditioning amplifier and radio transmitter unit, generally designated by the numeral 100. The transmitter unit 100 is provided with one or more FM radio transmitters 102 disposed on support means 104 and disposed for beaming output signals to a receiving antenna 106 mounted on a support characterized by opposed depending legs 108 and 110 which are secured to the frame 21. The antenna 106 is connected to a suitable signal transmitting cable 114 which transmits the signals generated by the strain gages and accelerometers by way of the transmitter unit 100 to a receiver 116. The receiver 116 may include means for converting the signals to a form which may be analysed by digital computer. In this way, certain kinds of computer processing may be carried out to determine particular vibration modes of the drillstem. Spectral analysis of the signals received by the various accelerometers and strain gages may be carried out to identify particular frequencies. Such analyses could also be correlated with downhole measurements taken by conventional measurement-while-drilling (MWD) tools. Accordingly, with some level of interpretive skill, surface measurements taken by the system of the present invention can be correlated with certain formation characteristics, for example.

Figure 6A:
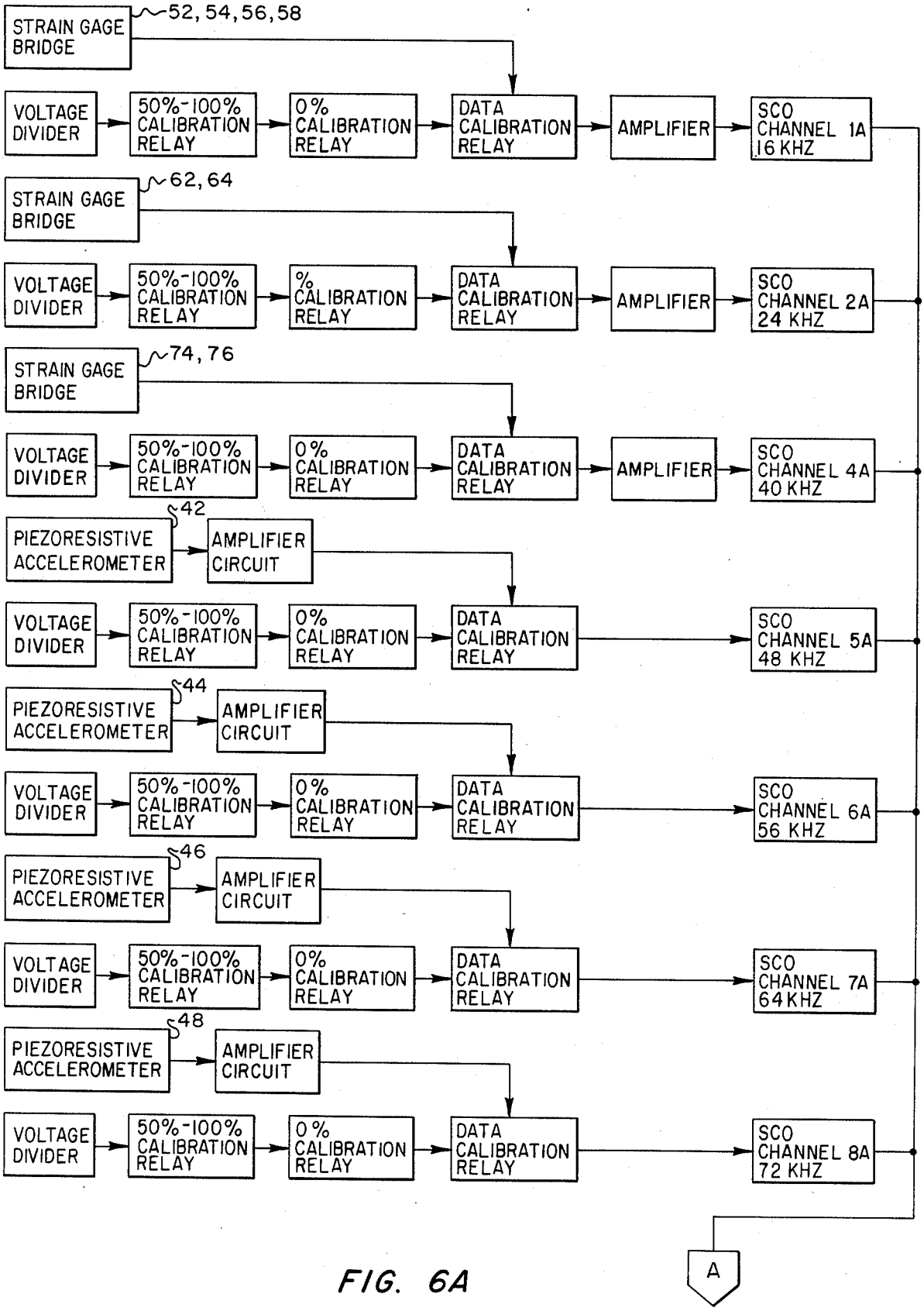
FIGS. 6A and 6B comprise a schematic diagram of the major components of the drillstem loading and behavior measuring system.
Figure 6B:
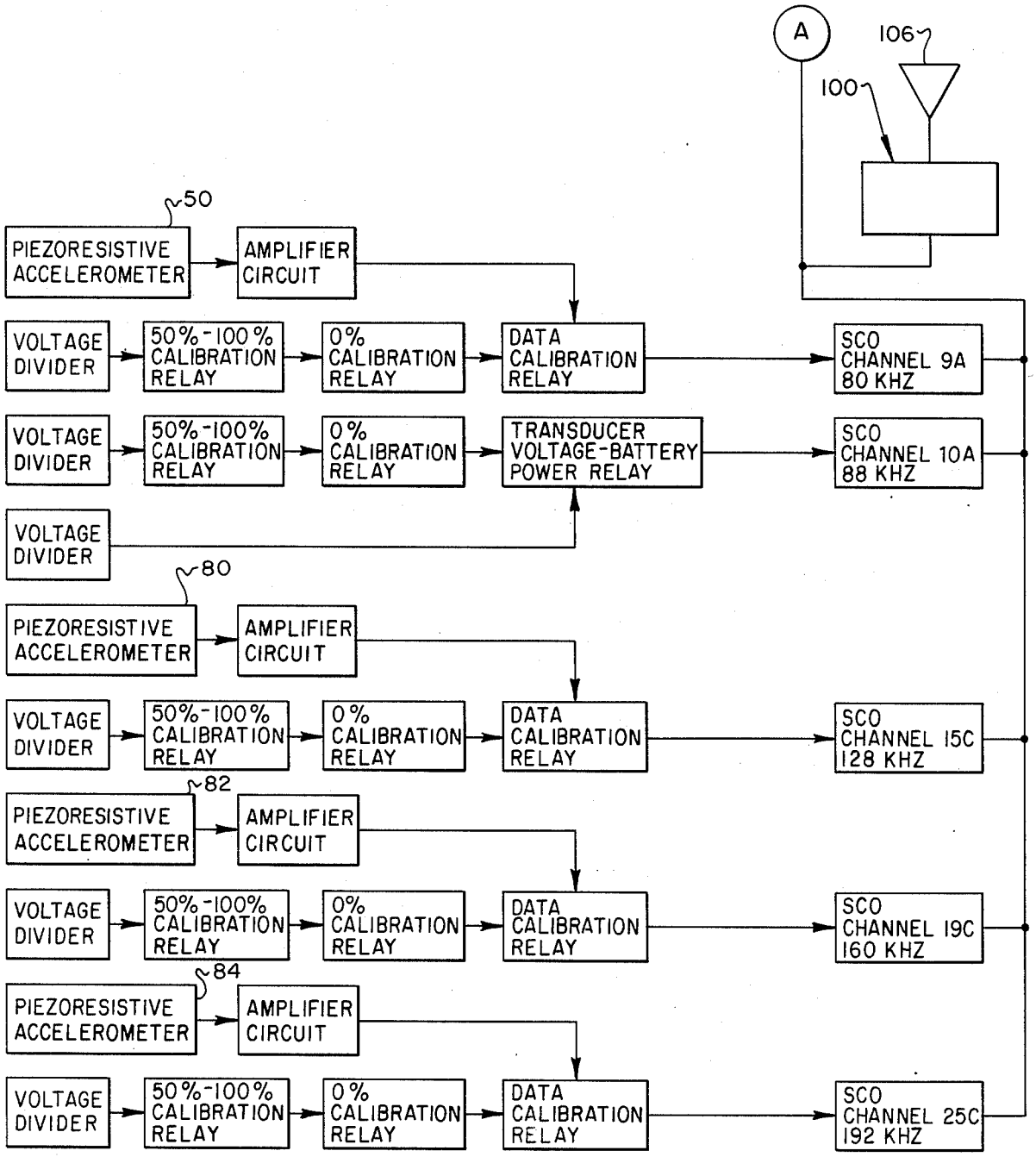

FIGS. 6A and 6B comprise a block diagram showing the arrangement of each of the strain gage circuits and accelerometers with respect to certain components such as voltage dividers, calibration relays and for each signal generating circuit, a subcarrier oscillator which provides a sideband radio frequency signal to an amplifier-mixer and then to a telemetry transmitter in circuit with the antenna 106.

The respective portions of the diagram shown in FIGS. 6A and 6B are interconnected by the connector labeled "A". The particular type of telemetry system for transmitting the signals from the drillstem 20 to a receiver such as the receiver 116 may be modified to use suitable hardwired signal transmitting devices or to provide microwave range radio frequency signals.

The signals generated by the respective accelerometers may be correlated to determine what mode of vibration the drillstem is operating in and, on the basis of comparing certain vibrations, the location of drillstem-casing interaction, speed of rotation of the bit 26, and bit interaction with the formation being drilled. These parameters can, of course, be utilized to modify the drilling rate, prevent excessive wear on the drillstem and/or the casing or other structure in which the drillstem is disposed. For example, axial vibrations manifested by waves traveling along the surface of the drillstem 20 can be measured by the strain gages 62 and 64 and torsional vibration waves also traveling along the surface of the drillstem can be measured by the strain gages 74 and 76. Large amplitude torsional vibrations can be detected by the acclerometers 44, 46 and 80 and bending modes of the drillstem can be detected by the acclerometers 50 and 84. Moreover, if the signals being output from the acclerometers 44 and 46, for example, are in phase, that is, the signal amplitude from the accelerometer 44 is negative when the signal amplitude from the accelerometer 46 is positive, or vice versa the movement of the sub 36 and the drillstem 20 is in a bending mode. If the signal output from the accelerometers 44 and 46 are out of phase as indicated by positive vectors 45 and 49 of the vector diagrams, a torsional vibrating mode is being sensed. In like manner, if the signal output from the axial accelerometers 42, 48 and 82 are in phase, axial vibrations are occurring, whereas if the signals being generated by the accelerometers 42 and 48 are out of phase, for example, a bending mode is being experienced.

The location of interaction between the drillstem 20 and the wellbore casing 22 or other downhole structure may be determined by measuring torsional vibrations and axial vibrations which exhibit a particular phase relationship. The actual location downhole of the interaction between the drillstem and the casing, for example, can be determined using the parameters including longitudinal and torsional wave speed in steel such as described in SPE Paper No. 14327 published by the Society of Petroleum Engineers, P.0. Box 833836, Richardson, TX, 75083. The time difference between the arrival of an axial wave peak at the surface as measured by the strain gages 62 and 64 as compared with the arrival of a torsional wave peak as measured by the torque strain gages 74 and 76 can be used to determine the location of the casing-drillstem interaction since the longitudinal wave speed and torsional wave speed can be calculated for a particular material such as steel wherein the modulus of elasticity and the density of the material are known.

Although axial and torsional vibrations from different sources, such as the drillbit sticking and releasing and from casing-drillstem interaction, may be occuring substantially simultaneously, the various vibration modes of the drillstem as sensed by the sensing devices described above can be ascertained from analysis of the signals recorded to distinguish one vibration source from another. For example, drillbit vibrations and vibrations caused by downhole bit driving motors typically generate standing vibration waves while the phase difference in waveforms caused by intermittent interactions, such as drillstem and casing interaction, are seen as propagating waves.

The measurement system described in conjunction with FIGS. 1 through 5 can be modified for use with a drilling apparatus having a so-called top drive or power swivel arrangement as compared with the rotary table type drive and the free rotation type swivel 17. In fact, no modification is required and the arrangement illustrated and described herein can be used for a drive arrangement wherein a powered swivel sub, not shown, is drivingly connected to the sub 37. In such an arrangement, the kelly 34 may, in fact, be omitted and the sub 38 connected directly to the sub 36. Alternatively, the strain gages 74 and 76 could be mounted on a modified version of the sub 36.

One particular advantage of the arrangement of the spaced apart subs 36 and 38 with the respective sets of accelerometers mounted thereon as shown and described, pertains to the ability with such an arrangement to make mode wave form or shape predictions. Typically, for example, for drilling conditions wherein the drill string may be lengthened to extend to 7,000 ft. to 15,000 ft. wellbore, the spacing of the flanges 40 and 70 may be on the order of 40 feet to 50 feet in order that a measurable time delay of the wave propagation can be predicted by the accelerometer 82 as compared with a measurement taken by either of the accelerometers 42 or 48 as a measurement of the axial wave. Concomitantly, the torsional wave may be detected by comparing readings from the accelerometer 80 as compared with the time delay for the signal to be measured by the accelerometers 44 and/or 46. Still further, the direction of bending of the drill stem may be predicted by comparing the readings of the accelerometers 50 and 84. Substantially, all of the measuring means described hereinabove and shown on FIG. 6 are commercially available elements. Brand names and sources of the respective sensing elements identified in FIG. 6 are as follows:

Strain gages 52, 54, 56, 58, 74 and 76, Kulite Semiconductor Products, Inc. Ridgefield, New Jersey;

Strain gages 62 and 64, Micromeasurements, Inc. Raleigh, North Carolina; and Accelerometers 42, 44, 46, 48, 50, 80, 82, and 84, Endevco Corporation San Juan Capistrano, California.

The accelerometers 46, 48 and 50 and 80, 82 and 84 may be respectively provided as triaxial type accelerometer units, if desired.

The operation of the measurement system described hereinabove is believed to be readily apparent to those skilled in the art from the foregoing description. The analysis of the signals generated by the respective measuring means may be carried out using Fourier transforms to separate and correlate meaningful signals which may be imposed on or masked by other signals resulting from other modes of vibration which are occurring simultaneously with the modes of interest.

The drillstem vibration, deflection and load measuring system described herein may also be used in conjunction with devices which may be applied to the drillstem for inducing oscillatory motions of drillstems for a variety of reasons. For example, both axial and radial vibrations might be induced in a drillstem for evaluating its behavior, including that of the bottom hole assembly, both before and while it is in operation and the induced oscillations may be modified in accordance with the signals received from the system of the present invention.

Although a preferred embodiment of a drillstem loading and behavior measuring system has been described in detail herein, those skilled in the art will recognize that various substitutions and modifications may be made to the specific embodiment shown and described without departing from the scope and spirit of the invention as recited in the appended claims.

What is claimed is:

1. A system for measuring the behavior of an elongated drillstem while forming a drillhole, said drillstem being characterized by elongated tubular means having a drillbit disposed at the lower distal end thereof to form a drillhole below the earth's surface, and said drillstem being connected substantially at its upper or opposite end to means for rotating said drillstem, said system comprising:

at least a first sub connected to an upper region of said drillstem, said first sub including a generally tubular member; and accelerometer means mounted on said first sub and adapted to produce electrical signals related to vibrations of said drillstem whereby the behavior of said drillstem at a point below said surface may be correlated with said vibration, said accelerometer means including at least two accelerometers disposed on said first sub in a common plane substantially opposite each other and on opposite sides of a longitudinal central axis of said first sub, said two accelerometers being capable of producing signals of variable amplitude indicating axial displacement of said drillstem in opposite directions and in such a way that in response to axial displacement of said first sub and bending displacement of said first sub, respectively, the signal amplitude of said two accelerometers may be compared to determine whether said drillstem is operating in an axial vibration mode or a bending vibration mode.

2. The system set forth in claim 1 wherein:

said accelerometer means includes at least a third accelerometer for detecting excursions of said drillstem laterally with respect to said longitudinal central axis of said drillstem during rotation of said drillstem for comparing said excursions with vibrations detected by said two accelerometers indicating a bending mode vibration of said drillstem.

3. The system set forth in claim 2 wherein:

said drillstem includes a second sub disposed spaced from said first sub in said drillstem and including a fourth accelerometer operable to provide a signal related to excursions of said second sub laterally with respect to said longitudinal central axis of said drillstem.

4. The system set forth in claim 2 including:

drillstem rotary drive means interposed between said first and second subs for rotatably driving said drillstem, and means disposed on said second sub for providing a signal related to torque imposed on said drillstem.

5. The system set forth in claim 8 wherein:

said means for providing a signal related to torque includes torsional strain measuring means for measuring torsional strain on said second sub.

6. The system set forth in claim 4 wherein:

said second sub is spaced apart from said first sub a distance sufficient to provide signals generated by said accelerometers of sufficient magnitude to determine the waveform of said vibration.

7. The system set forth in claim 1 including:

axial strain sensing means mounted on said first sub for sensing vibration propagating along the surface of said drillstem.

8. A system for measuring the behavior of an elongated drillstem while forming a drillhole, said drillstem being characterized by elongated tubular means having a drillbit disposed at the lower distal end thereof to form a drillhole below the earth's surface, said system comprising:

at least a first sub connected to an upper region of said drillstem, said sub first including a generally tubular member;

means interposed between said first sub and said drillbit for rotating said drillstem;

accelerometer means mounted on said first sub and adapted to produce electrical signals related to vibrations of said drillstem whereby the behavior of said drillstem at a point below said surface may be correlated with said vibrations, said accelerometer means including at least two accelerometers disposed on said first sub substantially opposite each other and on opposite sides of a longitudinal central axis of said first sub, said two accelerometers being capable of producing signals of variable amplitude indicating displacement of said drillstem in a plane normal to said longitudinal central axis in such a way that in response to rotational displacement of said first sub about said longitudinal central axis and bending displacement of said first sub, respectively, the signal amplitude of said two accelerometers may be compared to determine whether said drill stem is operating in a torsional vibration mode or a bending vibration mode.

9. The system set forth in claim 8 wherein:

said accelerometer means includes at least a third accelerometer for detecting excursions of said drillstem laterally with respect to said longitudinal central axis of said drillstem during rotation of said drillstem for comparing said excursions with vibrations detected by said two accelerometers indicating a bending mode vibration of said drillstem.

10. The system set forth in claim 9 wherein:

said drillstem includes a second sub disposed spaced from said first sub in said drillstem and including a fourth accelerometer operable to provide a signal related to excursions of said second sub laterally with respect to said central longitudinal axis of said drillstem.

11. A method for determining the location of interaction between an elongated rotary drillstem and a downhole structure in a wellbore wherein said drillstem is characterized by an elongated tubular member having a drillbit or the like disposed at the lower distal end thereof to form a drillhole and said drillstem being connected substantially at its upper or opposite end to means for lifting or lowering said drillstem, said method comprising:

providing a sub disposed at an upper region of said drillstem, said sub comprising a generally tubular member;

providing first means on said sub for measuring at least an axially directed surface deflection wave on the outer surface of said sub, said surface deflection wave being related to an axial deflection of said drillstem;

providing second means on said sub for measuring a torsional deflection wave propogated along the surface of said drillstem and related to interaction between said drillstem and a downhole structure;

measuring axial and torsional strains on said drillstem related to signals produced by said first and second means, respectively; and comparing the time difference between an axial peak strain sensed by said first means and a torsionally induced peak strain sensed by said second means for determining the location of said interaction between said drillstem and said downhole structure, 12. A method for measuring deflections of an elongated drillstem while forming a drillhole in the earth's surface, said drillstem including a drillbit disposed at the lower distal end thereof and said drillstem having a sub disposed at the upper end thereof, said method comprising:

providing first and second accelerometers mounted on said sub opposite each other and on opposite sides of a longitudinal central axis of said drillstem, said first and second accelerometers being capable of providing signals of variable amplitude in such a way that axial displacement of said drillstem in opposite directions may be determined from the signals being generated by said first and second accelerometers, respectively;

providing means for transferring the signals generated by said first and second accelerometers;

measuring the signals generated by said first and second accelerometers during rotation of said drillstem to form a drillhole; and comparing the signals generated by said first and second accelerometers to determine if said drillstem is being vibrated in an axial mode or a bending mode, respectively.

13. The method set forth in claim 12 including the steps of:

providing a third accelerometer disposed on said drillstem spaced from said longitudinal central axis of said drillstem and opposite said second accelerometer for producing signals of variable amplitude; and comparing signals generated by said second and third accelerometers to determine a torsional vibration mode or a bending vibration mode of said drillstem.

14. The method set forth in claim 12 including the steps of:

providing strain measuring means disposed on said drillstem including means for producing electrical signals related to axial and torsional deflections of said drillstem, respectively; and comparing signals generated by said axial and torsional deflections of said drillstem for determining the location of interaction between said drillstem and said downhole structure.

15. A method for measuring deflections of an elongated drillstem while forming a drillhole in the earth's surface, said drillstem including a drillbit disposed at the lower distal end thereof and said drillstem having a sub disposed at the upper end thereof, said method comprising:

providing first and second accelerometers mounted on said sub opposite each other and on opposite sides of a longitudinal central axis of said drillstem, said first and second accelerometers being capable of providing signals of variable amplitude in such a way that torsional displacement of said drillstem in opposite directions about said axis may be determined from the signals being generated by said first and second accelerometers, respectively;

providing means for transferring the signals generated by said accelerometers;

measuring the signals generated by said first and second accelerometers during rotation of said drillstem to form a drillhole; and comparing the signals generated by said first and second accelerometers to determine if said drillstem is being vibrated in a torsional mode or a bending mode, respectively.

* * * * *